United States Patent [19]

Niehaus

[11] Patent Number: 4,864,927

[45] Date of Patent: Sep. 12, 1989

[54] ROTARY MULTICOLOR PRINTING PRESS

[75] Inventor: Manfred Niehaus, Bielefeld, German Democratic Rep.

[73] Assignee: Werner Kammann Maschinenfabrik GmbH, Fed. Rep. of Germany

[21] Appl. No.: 235,260

[22] Filed: Aug. 23, 1988

Related U.S. Application Data

[63] Continuation-in-part of Ser. No. 900,864, Aug. 27, 1986, abandoned.

[30] Foreign Application Priority Data

Aug. 31, 1985 [DE] Fed. Rep. of Germany ..... 3531193

[51] Int. Cl.[4] ..... B41F 5/16

[52] U.S. Cl. ..... 101/181; 101/248

[58] Field of Search ..... 101/211, 178, 179, 180, 101/181, 182, 183, 135, 136, 137, 138, 141, 212, 216, 219, 220, 221, 229, 231, 247, 248

[56] References Cited

U.S. PATENT DOCUMENTS

| | | | |
|---|---|---|---|
| 2,084,281 | 6/1937 | Meisel . | |
| 2,560,774 | 7/1951 | Luttenauer . | |
| 2,619,033 | 11/1952 | Lembo . | |
| 2,690,121 | 9/1954 | Auerbacher et al. . | |
| 3,179,045 | 4/1965 | Evers . | |
| 3,196,787 | 7/1965 | Finke . | |
| 3,863,566 | 2/1975 | Schirrich et al. . | |
| 3,869,983 | 3/1975 | Garber et al. | 101/137 |
| 4,019,434 | 4/1977 | Hoexter | 101/216 |
| 4,210,481 | 7/1980 | Wolff et al. | 101/247 |
| 4,563,949 | 1/1986 | Rogge . | |

FOREIGN PATENT DOCUMENTS 2111912A 7/1983 United Kingdom .

*Primary Examiner*—Eugene H. Eickholt

*Attorney, Agent, or Firm*—Panitch Schwarze Jacobs and Nadel

[57] ABSTRACT

In a rotary multicolor printing press for printing on a continuous web and comprising a plurality of printing units, each of which includes a plate cylinder driven by way of a main drive mechanism common to all of the printing units, there is disposed between the plate cylinder of each printing unit and the main drive mechanism, an adjustable parallel crank coupling which has no play in the direction of rotation thereof. The adjustable parallel crank coupling adjusts to various positionings of the plate cylinder to account for changing plate cylinder diameter and couples the variably positioned plate cylinders with a fixedly positioned first drive train connected with the main drive mechanism. Each printing unit further includes a separate impression cylinder driven from a shaft supporting the plate cylinder and coupled with the adjustable parallel crank coupling.

14 Claims, 3 Drawing Sheets

ROTARY MULTICOLOR PRINTING PRESS

CROSS-REFERENCE TO RELATED APPLICATION

This application is a continuation-in-part of co-pending application Ser. No. 900,864, filed Aug. 27, 1986 and now abandoned.

FIELD OF THE INVENTION

This invention relates generally to rotary multicolor printing presses and, in particular, to high speed presses having several print stations for sequential overlapping printing on a continuous web.

BACKGROUND OF THE INVENTION

Rotary multicolor printing presses to which the invention is directed have a plurality of printing stations or printing units and a central drive gear which is common to all the printing units for operation thereof.

Machines of this kind may be, for example, the printing presses known as flexo or flexographic printing presses. Such presses are commonly used for high speed printing on material in web form. The web to which the printed image is to be applied is passed in the respective printing unit between a plate cylinder thereof and a cooperating impression cylinder. The plate cylinder is arranged for linear contact with the web to minimize the possibility of smearing the image. The fact that the press has a plurality of printing units permits a plurality of inks of different colors to be applied to the web in successive printing operations. Arrangements for drying the printing ink which is applied in a given printing unit may be disposed downstream of that unit for drying the ink which has just been applied, so that a plurality of such drying devices are disposed between respective adjacent printing units. The web may range from very absorbent materials having relatively low image registration accuracy requirements, such as textile fabrics, to smooth, thin plastic films and metal foils having virtually no ink absorbency and very high image registration requirements arising both from the difficulties of handling and printing on such materials and the detail of the images often required to be printed on such materials.

In one common form of such presses, each of the printing units includes an inking mechanism, a plate cylinder and an individual impression cylinder cooperating with only the plate cylinder of the printing unit. Typically, each plate cylinder of the respective printing units is driven by the above-mentioned central drive gear by way of a further gear which is generally non-rotatably connected to the respective plate cylinder. The drive for the respectively associated impression cylinder in each printing unit may be derived from the drive for the plate cylinder or directly from the central drive gear. By gear driving the plate cylinders directly from the central drive gear, the sources of play between the central drive gear and each plate cylinder, and thus misregistration (angular misalignment) among the plate cylinders are minimized.

In another common form of such rotary multicolor printing press, a single central impression cylinder of a correspondingly large diameter is provided cooperating with all of the plate cylinders. In such presses, the plate cylinders of the individual printing units are arranged at the periphery of the single central impression cylinder. Such a printing press design is intended to take account of the fact that, when printing very thin material, for example films or foils from which carrier bags are to be produced, such material is frequently subject to considerable stretch effects when using the conventional printing units in which each plate cylinder has associated therewith its own respective impression cylinder. By using a large impression cylinder, as indicated above, there is less stretching of the material occurring, due to the large contact surface area between the impression cylinder and the web of material to be printed. Consequently, the web is moved with a high degree of accuracy and minimal unwanted stretch through and between the print stations. Generally speaking, this provides for more accurately registered individual images and thus a sharper overall multicolor image than can be achieved with presses employing separate impression cylinders associated with each print station. However, the large single impression cylinder entails a disadvantage, namely expense. A large central impression cylinder is extremely expensive to manufacture, especially as the peripheral surface thereof must be machined to a very high degree of accuracy and the diameter thereof must be kept constant also with a high degree of accuracy.

British laid-open application GB 2 111 912 (corresponding to German laid-open application (DE-OS) No. 31 50 833, now Patentschrift No. 3 150 883) discloses a flexographic rotary multicolor press with cooperating pairs of plate and impression cylinders which can be adjusted to accommodate print format changes, i.e., changes in the plate cylinder diameters. The press includes six printing units each with an impression cylinder supported by vertical frame members within the circumference of a main or central drive gear. Each printing unit further includes a plate cylinder supported with inking cylinders on lands arranged around the central drive gear. Each of the printing mechanisms of this press include a gear connected to the plate cylinder, a gear connected to the impression cylinder, and the two gears directly engaged with the central drive gear. Whenever the diameter of the plate cylinders is altered, it is necessary for the plate cylinders to be repositioned, due to the changes in the spacings between the axes of rotation thereof as a result of the changes in the diameters of the plate cylinders, in order to keep the plate cylinder gears engaged with the central drive gear. In addition, the impression cylinders also have to be repositioned, at least in some of the printing units or stations, to keep the plate and impression cylinder pairs in diametric alignment with the central gear to prevent wrap of the web around the plate cylinder. Thus, format changes involve radial and often tangential movement of the plate cylinders and often tangential movement of the respective impression cylinders. That means that the operation of converting the machine to different formats to be printed becomes a complicated operation. Furthermore, when the position of both the plate cylinders and also the respectively cooperating impression cylinders are changed, the length of the portion of material to be printed, between two adjacent printing units, also changes with the result that further additional modifying steps have to be taken when setting the printing press after a change in format.

From the foregoing, it can be seen that it is desirable to provide as high a degree of accuracy in registration as is economically feasible in high speed rotary multicolor presses employing separate impression cylinders to be able to compete favorably in terms of quality with more expensive presses employing a single central impression cylinder.

It is further desirable to provide in such presses the ability to simply and rapidly convert between different print formats while maintaining a high degree of accuracy of registration.

SUMMARY OF THE INVENTION

An object of the present invention is to provide a rotary multicolor printing press with plural impression cylinders which is at least substantially free from the above-mentioned disadvantages of such prior-art machines.

Another object of the present invention is to provide a rotary multicolor printing press designed so as to permit conversion thereof to different print formats quickly and simply without major complications.

Yet another object of the present invention is to provide a rotary multicolor printing press designed so as to make it unnecessary to reposition impression cylinders when changing print formats.

A still further object of the present invention is to provide a rotary multicolor printing press which permits easy and rapid adaptation of the inking mechanism to a different print format from that for which the machine has been previously set.

Yet a further object of the present invention is to provide a rotary multicolor printing press which enjoys a high level of register accuracy.

It is yet another object of the present invention to provide a flexographic rotary multicolor press with plural impression cylinders for printing on smooth, thin plastic film webs with a high level of accuracy of registration.

In accordance with the teachings of the present invention, these and other objects are achieved by a rotary multicolor press for printing on a continuous web which includes a plurality of printing units and a main drive mechanism wherein each printing unit comprises: a plate cylinder having any diameter within a range of permissible diameters, inking means for inking the plate cylinder, and first drive means engaged with the main drive mechanism for driving the plate cylinder from the main drive mechanism. Each printing unit further comprises adjustable parallel crank coupling means for rotatably coupling together the first drive means and the plate cylinder without relative rotation therebetween. The parallel crank coupling means is adjustable radially with respect to at least the plate cylinder for rotatably coupling the first drive means with plate cylinders of different diameters.

Further objects, features and advantages of the present invention will be more clearly apparent from the following description of a preferred embodiment thereof.

DESCRIPTION OF THE PREFERRED EMBODIMENT

Figure 1:
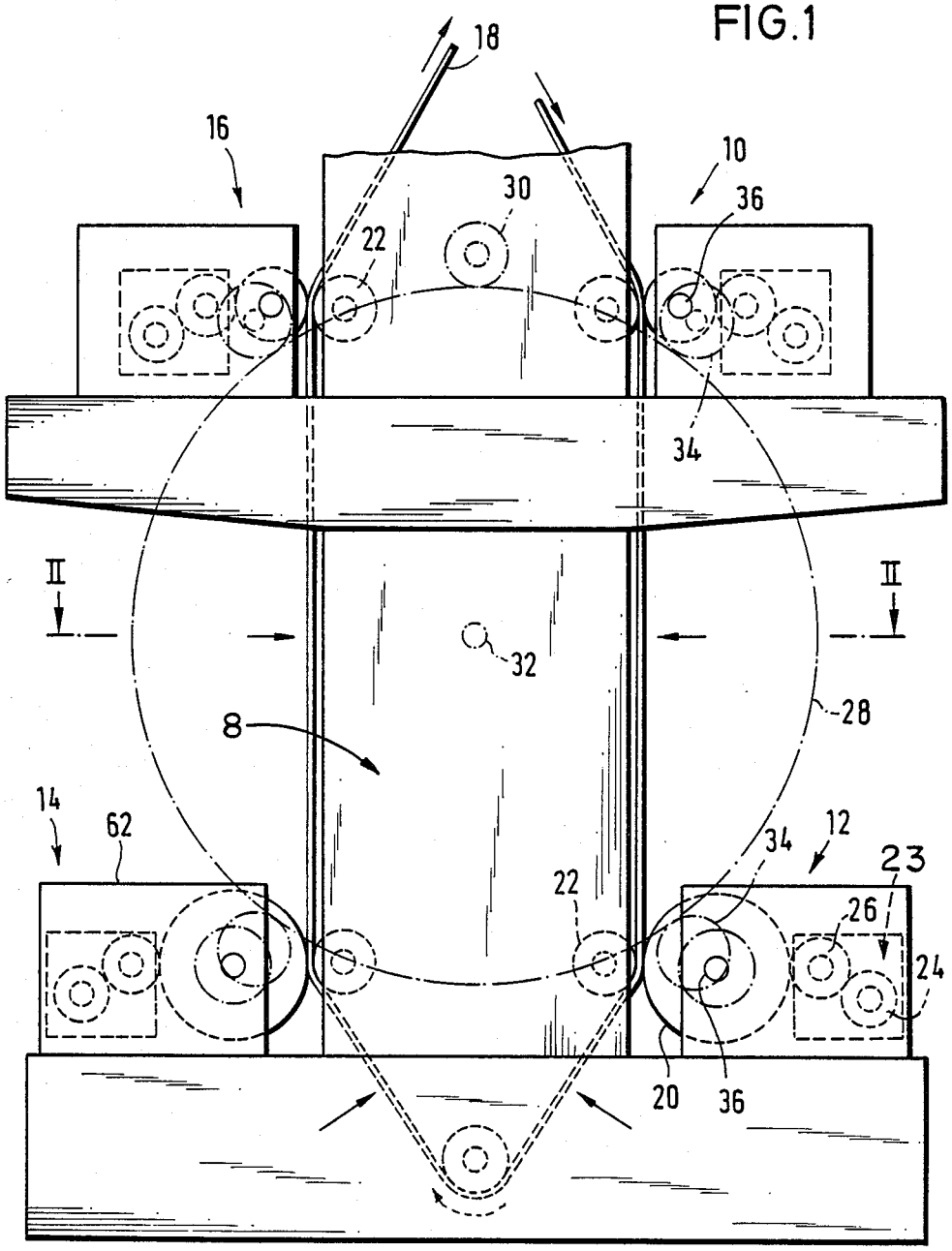
FIG. 1 is a side view of a printing press according to the present invention.

Referring now to the drawings, shown therein is a construction of a rotary multicolor printing press, which preferably is a flexo or flexographic press, in accordance with the present invention. The press comprises frame means, indicated generally at 8, supporting a plurality of printing stations or units. The illustrated embodiment has four printing units indicated respectively at 10, 12, 14 and 16. Reference numeral 18 denotes a continuous web of material which is to be printed upon in the printing press, for which purpose the web of material 18 is passed continuously through the successive printing units 10, 12, 14 and 16.

Each of the printing units 10, 12, 14 and 16 is of at least substantially the same construction, so that one of the printing units, unit 12, will now be described in greater detail.

Still referring to FIG. 1, printing unit 12 comprises a plate cylinder means for printing on the web including a plate cylinder 20 and a shaft 36 supporting the plate cylinder 20 for rotation. The printing unit 12 further comprises impression cylinder means including a separate impression cylinder 22 cooperating with the plate cylinder 20. The web 18 of material to be printed passes between the respective plate cylinder 20 and the associated impression cylinder 22, in the usual fashion. The respective printed image is applied to the web 18 of material by the plate cylinder 20. Printing unit 12 is further provided with an inking means or inking mechanism 23 for inking the plate cylinder 20. The inking means 23 is indicated diagrammatically and comprises an ink supply roll 24 which dips into a reservoir of ink (not depicted) to pick up ink therefrom, and an inking roll 26 which is in contact with the roll 24 and which transfers the ink thereon to the surface of the plate cylinder 20.

Figure 2:
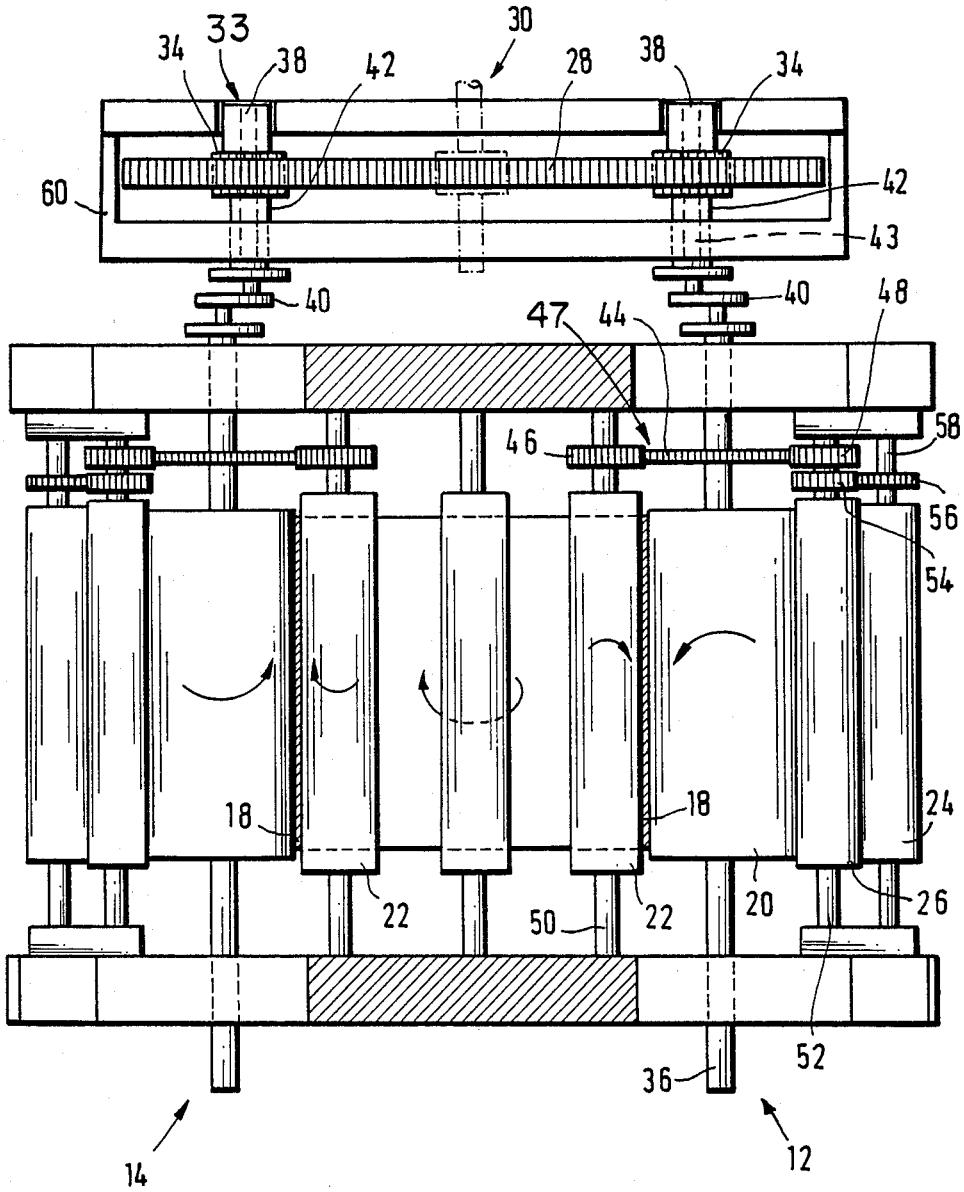
FIG. 2 is a view partly in section along line II—II indicated in FIG. 1.

The respective printing units 10, 12, 14 and 16 are each commonly driven by way of a main drive mechanism, in this case a central drive gear 28, which is driven in rotation about its axis as indicated at 32 in FIG. 1 (both in phantom), by way of a shaft as indicated at 30 in FIG. 2. The shaft 30 is in turn driven by a suitable drive motor or other prime mover (not shown). The frame means 8 supports the central drive gear 28 and the various printing units 10, 12, 14, 16 around the central drive gear 28 for driving each of the printing units 10, 12, 14 and 16 thereby.

Further associated with each printing unit 10, 12, 14 and 16 is a first drive means or train 33 (see FIG. 2) engaged with the central drive gear 28 for driving the plate cylinder 20. The first drive mean 33 includes a first gear 34 which, as can be seen from both FIGS. 1 and 2, meshes with the central drive gear 28. Transmission of the drive torque from the first gear 34 of each printing unit 10-16 to the shaft 36 which carries the respective plate cylinder 20 is effected by way of an interposed differential transmission as indicated in diagrammatic form at 38 in FIG. 2, which forms an additional part of the first drive means 33, and an adjustable parallel crank coupling means, preferably a Schmidt coupling, as indicated in diagrammatic form at 40 in FIG. 2. The shaft 36 and plate cylinder 20 are non-rotationally coupled together.

As can be clearly seen from FIG. 2, the first gear 34 of each of the respective printing units 10–16 is supported for rotation on and drives a hollow shaft 42.

Hollow shaft 42 is a part of the first drive means 33 and is journalled into the frame portion 60. The hollow shaft 42 is connected to the differential transmission 38. Within the hollow shaft 42 is disposed a shaft 43, as shown in FIG. 2, which represents the output drive of the differential transmission 38 and which, in turn, is connected with and drives the parallel crank coupling 40. The differential transmission 38 is provided for precise angular adjustment of the respectively associated plate cylinder 20 so that all the plate cylinders 20 of the printing units 10, 12, 14 and 16 can be brought into the correct relative angular position for accurate registration of the overlapped images printed successively by the printing units 10, 12, 14, 16 on the web 18. The correct angular position of the plate cylinder 20 is based on the position of the printed image applied by the plate cylinder 20, relative to the position of the printed image which is applied by each of the other plate cylinders 20. The accuracy of registration of these layered images with one another determines the sharpness and thus the quality of the composite, multicolor printed image. The first drive means 33, comprising first gear 34, differential transmission 38, and shafts 42 and 43, remains mounted at a fixed, predetermined position in the portion 60 of the frame means 8 during operation and during print format changeovers.

The adjustable parallel crank coupling 40 is provided between the differential transmission output shaft 43 of the first drive means 33 and the respectively associated plate cylinder 20 in each printing unit 10–16 to take account of the fact that, depending on the length of the printed image to be applied to the web 18 of material, plate cylinders 20 of different formats, that is to say of different diameters, are used. The adjustable parallel crank coupling 40 is a machine component for the transmission of torques between shafts which are displaced relative to each other with their axes in parallel relationship. Preferably, the adjustable parallel crank coupling is one commonly known as a Schmidt coupling. The Schmidt coupling is adjustable as to both magnitude and direction of the radial displacement or offset between the parallel shafts 43 and 36. That is to say, the displacement between the shafts 36 and 43 (and thus between first gear 34 and plate cylinder 20) can be varied radially by virtue of the action of a Schmidt type adjustable parallel crank coupling 40. The man skilled in the art will be aware of such mechanisms. For example, the invention may be carried into effect by using Schmidt couplings ("PK Kupplung") from Inkoma Maschinenbau of Cremlingen, Federal Republic of Germany.

Figure 3:
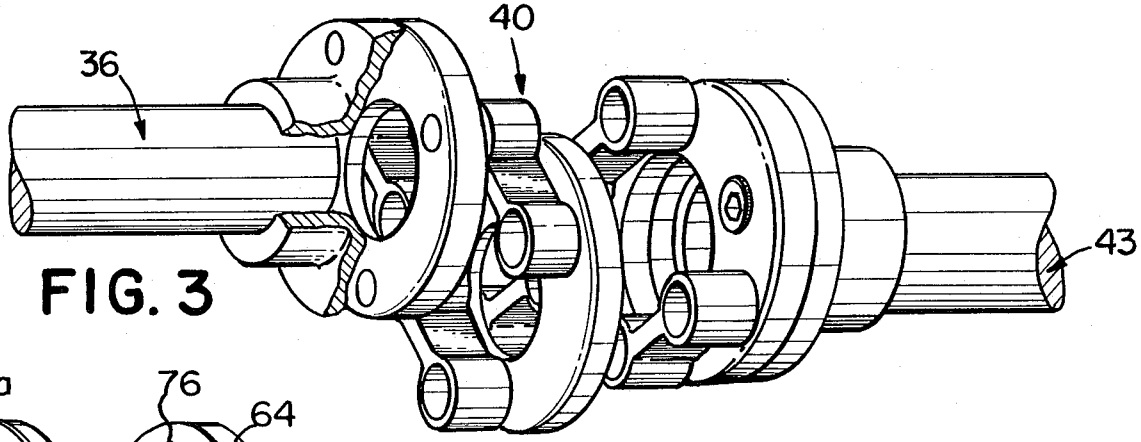
FIG. 3 is an isometric view of a Schmidt type adjustable parallel crank coupling in the drive train between each plate cylinder and the central drive gear.
Figure 4:
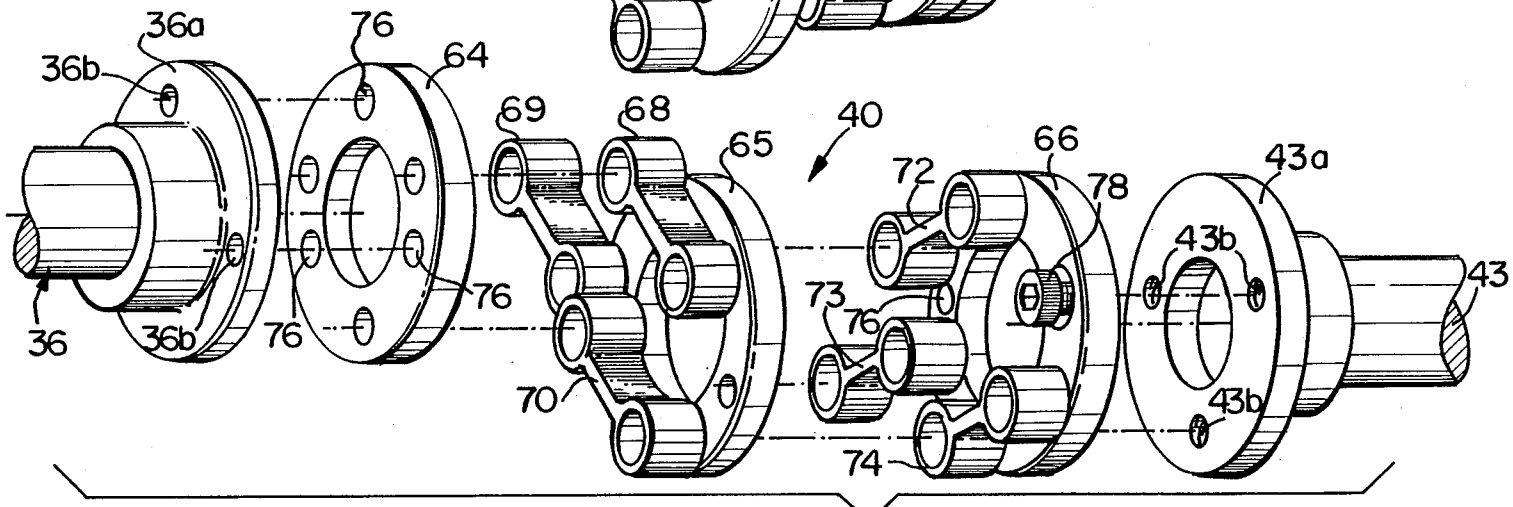
FIG. 4 is an exploded view of the coupling of FIG. 3.

One of the Schmidt type adjustable parallel crank couplings 40 distributed by Inkoma Maschinenbau is depicted in detail in FIGS. 3 and 4. The coupling 40 includes three ring members 64, 65 and 66. Rotatably coupled to one annular side of the central ring member 65 is one end of each of a first set of three rigid links or cranks 68, 69 and 70. The cranks 68, 69 and 70 are of equal length. The ends of cranks 68, 69 and 70 are uniformly angularly spaced at 120 degree increments around the central ring member 65. The other ends of each of the cranks 68, 69 and 70 are rotatably coupled to end ring member 64 on an annular side of that member 64 facing the central ring member 65, again at uniform 120 degree angular increments. Rotatably coupled to the other annular side of the central ring member 65 is one end of each of three additional rigid links or cranks 72, 73 and 74. The cranks 72, 73 and 74 are also equal in length to one another and equal to the length of cranks 68, 69 and 70 of the other set. Ends of cranks 72, 73 and 74 are also rotatably coupled to the central ring member 65, uniformly angularly spaced at 120 degree increments around the central ring member 65 and uniformly angularly spaced at 60 degree increments from the ends of the first set of cranks 68, 69 and 70 attached to the opposite side of central ring member 65. The other ends of the cranks 72, 73 and 74 are rotatably coupled with the remaining end ring member 66 at uniformly angularly spaced 120 degree increments around the annular face of that member 66 facing the central ring member 65.

Referring to FIG. 4, each of the end ring members 64 and 66 has been provided with a set of three bores 76 preferably uniformly angularly spaced for balance around the member and from the connection points of the cranks 68, 69, 70 and 72, 73, 74, respectively. The bores 76 permit the end ring members 64 and 66 to be connected and disconnected readily with shafts 36 and 43, respectively, through flanges **36*a* and 43*a* provided at the ends of those shafts adjoining the Schmidt coupling 40. Each flange 36*a* and 43*a* is nonrotatably coupled with its associated shaft 36 and 43, respectively, by conventional means not depicted such as keying or welding. Each flange 36*a* and 43*a* has set of bores 36*b* and 43*b*, respectively, preferably symmetrically positioned for balance for receiving bolts 78 passed through the bores 76. The bores 43*b* and 38*b* may be threaded (not depicted) for threadingly receiving bolts 78 or unthreaded so that nuts (not depicted) may be attached to threaded ends of the bolts 78 to secure the flanges 36*a* and 43*a* to the end ring members 64 and 66**, respectively.

The cranks 68, 69, 70 are parallel to one another and cranks 72, 73, 74 are parallel to one another during rotational operation (hence the name, parallel crank coupling). The end ring members 64 and 66 can be coupled with parallel shafts 36 and 43 displaced from one another in any radial direction from either shaft, to the distance permitted by the lengths of the cranks (actually slightly less than twice the length of one crank).

The Schmidt coupling is favored in this application for its ability to adjust radially with respect to the plate cylinder 20, and thereby accommodate plate cylinders 20 of differing diameters within a range predetermined by the degree of radial displacement permitted between the end ring members 64, 66 by the cranks 68–70, 72–74. It is favored also for its ability to couple the shaft 36 and 4 and thus the plate cylinder 20 and first gear 34 together with no or essentially no play or clearance in the direction of rotation of the coupling 40. While there may be some rotational flexure of the coupling under torsional loads, the flexure is minimal and, in any event, is, during operation, substantially constant and equal in the various printing units 10, 12, 14 and 16. Moreover, unlike a Hooke or Carden type universal joint and some other conventional rotational couplings, the Schmidt coupling 40 drives the plate cylinder shaft 36 absolutely synchronously with respect to the output shaft 43 (i.e., without any relative rotation therebetween) through the entire 360 degree rotational cycles of those shafts. The transmission 38 is also free of play or clearance in the peripheral direction thereof.

In the case of the printing press embodiment illustrated in the drawings, the adjustable parallel crank coupling 40 bridges across the lateral (i.e., radial) spacing or relative displacement between the shaft 36 on which the plate cylinder 20 is carried and the shaft 43 which forms the output or drive shaft of the differential transmission 38. It also bridges the axial spacing between frame portion 60 in which the central drive gear 28 and first drive means 33 of each printing unit 10–16 is permanently and fixedly mounted for rotation, regardless of plate cylinder diameters, and the shafts 36 of the plate cylinders 20. It is further noted that the Schmidt coupling 40 does not require a significant axial spacing between the shafts 36 and 43 to couple those shafts together. Thus, press size can remain relatively compact.

It will now be noted that the plate cylinder 20, the inking cylinder 26 and the ink supply roll 24 with ink supply reservoir and the other ancillary equipment of each printing unit 10–16 are combined together to form a structural unit as indicated generally by reference numeral 62 in FIG. 1, in such a way that the components, and therefore the unit 62, are adjustable in dependence on the diameter of the plate cylinder 20. In particular, it is noted that the centers of the plate cylinder 20 and its support shaft 36 are maintained at the height of the center of the associated impression cylinder 22 (and its support shaft 50) so that the only translational adjustment required of the plate cylinder 20 in changing printing formats (i.e. diameters of plate cylinders 20) is a horizontal linear movement towards and away from the associated impression cylinder 22. Furthermore, as is indicated in FIG. 1, the inking means 23 can also be supported for horizontal movement in the structural unit 62, to easily accommodate changes in the diameter of the plate cylinder 20. This simplifies greatly both the construction of the individual structural units 62 and their adjustment for maintenance and print changes.

A particular advantage of the present system is that even when there is a change in plate cylinder 20 from one diameter to a different diameter, there is no need to alter the position of the respective impression cylinder 22. Consequently, the impression cylinder 22 can be fixedly positioned in the frame means 8, even though the press is otherwise adapted to use plate cylinders 20 of different diameters. A related advantage is that the first drive means 33 including first gear 34 and differential transmission 38 with output shaft 43 can also be fixedly located in the frame portion 60 and need not be disturbed, other than to provide a possible angular adjustment of the plate cylinder 20 through the differential transmission 38, during print format (i.e. plate cylinder diameter) changes.

Referring now further to FIG. 2, it will be seen therefrom that a second gear 44 is non-rotatably connected to the plate cylinder 20 by being mounted non-rotatably on the shaft 36 supporting the respective plate cylinder 20. The second gear 44 of each printing unit 10–16 drives third and fourth gears 46 and 48. A third gear 46 is non-rotatably connected to the impression cylinder 22 of the printing unit by being fixedly carried on a shaft 50 on which the respective impression cylinder 22 is carried. The second and third gears 44 and 46 together comprise a second drive means 47 of each printing unit rotatably coupling together the adjustable parallel crank coupling means 40 and the impression cylinder 22 of each printing unit 10–16 for driving the impression cylinder 22 of each printing unit from the main drive mechanism, namely the central drive gear 28. A fourth gear 48 is fixedly mounted on a shaft 52 which in turn carries the inking roll 26. A fifth gear 54 which is also carried on the respective shaft 52 drives a sixth gear 56 which in turn is fixedly mounted on a shaft 58 carrying the ink supply roll 24. Thus, conversion of the press to different print formats entails merely exchanging units 62 (or just plate cylinders 20 and the position of the inking means 23), coupling shaft 36 of the replacement plate cylinder 20 to the adjustable parallel crank coupling means 40 and angular alignment of the various plate cylinders 20 through their respective differential transmissions 38.

The above-defined configuration in accordance with the principles of the present invention eliminates the necessity for also altering the position of the respective impression cylinder, when effecting a change in print format. On the contrary, it is now only necessary, with the construction of the present invention, for the inking mechanism 23 to be adapted to a new position adopted by the respective plate cylinder 20. The length of the portion of web 18 material to be printed, which occurs between each two respective adjacent printing units 10–16, can also remain unaltered when there is a change in printing format. As a result, the setting operations which are necessary in previous machines, after a change in format, including the operation of suitably positioning the plate cylinder 20, are also simplified. Furthermore, in the construction in accordance with the principles of the present invention, the only play or clearance between the common central drive gear 28 and the respectively associated plate cylinders 20 is tooth clearance in respect of the intermeshing gears, and that fact considerably increases the degree of accuracy with which the individual printed images are associated with each other.

Furthermore, the result of the arrangement as just described above is that, of the rolls or cylinders in each printing unit, the plate cylinder 20 is driven from the central drive gear 28, and the rotary movement of the other components, namely the impression cylinder 22 and the rolls 24 and 26, is in turn derived from the plate cylinder 20 associated therewith, or, more precisely, the shaft 36 carrying the respective plate cylinder 20.

In a modified form of the construction shown in the drawings, the gear 46, which is provided for transmitting drive from the gear 44 to the shaft 50 on which the respective impression cylinder 22 is disposed, may be connected to the shaft 50 by way of an interposed clutch arrangement so that the connection between the spur gear 46 and the impression cylinder 22 can be selectively interrupted if required. That is possible when, for any reason whatever, the respective impression cylinder 22 is not to be driven separately by the transmission of drive from the gear 44, but is to be simply entrained in rotary movement by contact with the web 18 of material to be printed.

Moreover, the arrangement is conventionally such that the pitch circle of the respective gear 44 corresponds to the outside diameter of the plate cylinder 20, as measured across the plate. In the same fashion, the pitch circles of the gears 46 and 48 correspond to the outside diameters of the respectively associated cylinder 22 and roll 26. In regard to the transmission of rotary movement from the shaft 5 to the ink supply roll 24, it is possible to select a transmission ratio which provides that the two rolls 24 and 26 rotate at different peripheral speeds. That is intended to ensure that the printing ink is uniformly distributed on the roll 26.

As the common central drive gear 28 is arranged in axially displaced relationship with respect to the printing units 10, 12, 14 and 16, as can be clearly seen from FIG. 2, to such an extent that it is in front of (or behind) the printing units, as considered in the axial direction of the respective rolls or cylinders thereof, the area through which the web 18 of material to be printed passes is readily accessible at from at least one side of the press. This situation can be clearly seen in FIG. 2 from which it will be appreciated that the central drive gear 28 is disposed on the side of the respective printing units which is at the top in FIG. 2, thus permitting ready access to the printing units from the side thereof which is at the bottom in FIG. 2. That arrangement also affords the possibility of the adjustable parallel crank couplings being disposed in a particularly simple manner in regard to the transmission of drive force to the respective printing units.

It will be appreciated that the abovedescribed construction in accordance with the present invention has been set forth solely by way of example thereof and that various modifications and alterations may be made therein without thereby departing from the spirit and scope of the invention.

We claim:

1. A rotary multicolor printing press including a plurality of printing units and a central drive gear for driving same, each printing unit comprising: an inking mechanism; a plate cylinder; an impression cylinder; a first gear non-rotatably connected to said plate cylinder and engaged with said drive gear; interposed between said plate cylinder and said first gear non-rotatably connected thereto an adjustable parallel crank coupling which is play-free in the direction of rotation thereof; a second gear non-rotatably connected to the plate cylinder; and a third gear non-rotatably connected to said impression cylinder and engaged with said second gear.

2. A press as set forth in claim 1 including a respective differential transmission means disposed between said central drive gear and each said plate cylinder.

3. A rotary multicolor printing press comprising: a plurality of printing units, each said unit including an inking mechanism, a plate cylinder having a shaft, and an impression cylinder having a shaft and co-operable with said plate cylinder; a central drive member operable to drive each of said printing units; and a respective transmission means connecting said central drive member to each said printing unit and including: a respective first drive means non-rotatably connected to the plate cylinder of each said printing unit and connected to said central drive member for driving the respective plate cylinder; an adjustable parallel crank coupling disposed between the respective said plate cylinder and said first drive means non-rotatably connected thereto, said adjustable parallel crank coupling being play-free in the direction of rotation thereof; a second drive means non-rotatably disposed on said shaft of said plate cylinder; and a third drive means non-rotatably disposed on said shaft of said impression cylinder and connected to said second drive means on said shaft of said plate cylinder.

4. A rotary multicolor press for printing on a continuous web, the press including a plurality of printing units and a main drive mechanism, wherein each printing unit comprises: a plate cylinder having any diameter within a range of permissible diameters; inking means for inking the plate cylinder; first drive means engaged with the main drive mechanism for driving the plate cylinder from the main drive mechanism; and adjustable parallel crank coupling means for rotatably coupling together the first drive means and the plate cylinder without relative rotation therebetween, the adjustable parallel crank coupling means being adjustable radially with respect to at least the plate cylinder for coupling the first drive means with plate cylinders of different diameters.

5. The press of claim 4 wherein each printing unit further comprises a separate impression cylinder.

6. The press of claim 5 further comprising frame means for supporting the impression cylinder of each printing unit at a fixed, predetermined location for co-operation with the plate cylinder of the printing unit having any diameter within the range of permissible diameters.

7. The press of claim 4 further comprising frame means for supporting each of the printing units and wherein the first drive means comprise an output shaft supported by the frame means at a fixed, predetermined location, an end of the output shaft being coupled to one side of the adjustable parallel crank coupling means, another side of the adjustable parallel crank coupling means being adapted for connection and disconnection readily with the plate cylinder at a location radially offset from the output shaft.

8. The press of claim 7 wherein the main drive mechanism comprises a central drive gear and wherein the first drive means further comprises a first gear meshing with the central drive gear and a differential transmission between the first gear and the output shaft, the first gear and the differential transmission being mounted at fixed, predetermined positions in the frame means supporting the output shaft for all permissible diameters of the plate cylinder of the printing unit.

9. The press of claim 5 further comprising second drive means rotatably connecting the adjustable parallel crank coupling means and the impression cylinder of the printing unit for driving the impression cylinder from the main drive mechanism through the first drive means of the printing unit.

10. The press of claim 9 wherein the main drive mechanism comprises a central drive gear and wherein the first drive means comprises a first gear meshing with the central drive gear and wherein the second drive means comprises a second gear non-rotatably connected with the plate cylinder and a third gear non-rotatably connected with the impression cylinder and meshing with the second gear.

11. The press of claim 10 wherein the plate cylinder and the second gear are mounted in the press for only linear transverse movement with respect to the impression cylinder and the third gear.

12. The press of claim 4 wherein the adjustable parallel crank coupling means comprises a Schmidt coupling.

13. The press of claim 12 in combination with a plastic film web passed through the plurality of printing units for printing thereon by the printing units.

14. The press of claim 4 in combination with a plastic film web passed through the plurality of printing units for printing thereon by the printing units.

* * * * *